US005584708A

United States Patent [19]

Leong

[11] Patent Number: 5,584,708

[45] Date of Patent: Dec. 17, 1996

[54] STRADDLE ELECTRICAL CONNECTOR

[75] Inventor: Jackson Leong, Singapore, Singapore

[73] Assignee: The Whitaker Corporation, Wilmington, Del.

[21] Appl. No.: 355,388

[22] Filed: Dec. 13, 1994

[30] Foreign Application Priority Data

Feb. 14, 1994 [JP] Japan ..... 6-039186

[51] Int. Cl.[6] ..... H01R 9/09

[52] U.S. Cl. ..... 439/79

[58] Field of Search ..... 439/79, 59, 80, 439/60, 81, 62, 876

[56] References Cited

U.S. PATENT DOCUMENTS

| | | | |
|---|---|---|---|
| 4,715,820 | 12/1987 | Andrews, Jr. et al. | 439/79 |
| 4,734,042 | 3/1988 | Martens et al. | 439/79 |
| 5,150,275 | 11/1992 | Nakamura et al. | 439/328 |
| 5,236,368 | 8/1993 | Adams et al. | 439/79 |

FOREIGN PATENT DOCUMENTS

| | | |
|---|---|---|
| 3-257776 | 11/1991 | Japan . |
| 4-78787 | 7/1992 | Japan . |
| 1466727 | 3/1977 | United Kingdom . |

*Primary Examiner*—Neil Abrams
*Assistant Examiner*—Eugene G. Byrd
*Attorney, Agent, or Firm*—Katherine A. Nelson

[57] ABSTRACT

A straddle connector avoids scraping off the solder from the conductive pads by the connection sections of electrical contacts during the connection of the connector to a circuit board. The straddle connector 10 comprises a housing 20 having an opening 21, and a separator 30 which is pushed by an edge 52 of the circuit board 50 when the latter is inserted in the opening 21. Connection sections 41 of the contacts 40 arranged in two rows along the inner walls of the opening 21 of the housing 20 are in contact with cam surfaces 31, 32 of the separator 30 which establishes a gap between opposing connection sections 41 during the insertion of the circuit board 50. After the insertion is completed, the gap between the connection sections 41 becomes smaller than the thickness of the circuit board 50, and the connection sections are applied to the solder-coated conductive pads 51 located on the surfaces of the circuit board at an appropriate pressure without scrapping solder from the conductive pads 51. Therefore, highly reliable SMT soldered connections are obtained when the solder is heated.

7 Claims, 2 Drawing Sheets

PRIOR ART

STRADDLE ELECTRICAL CONNECTOR

FIELD OF THE INVENTION

This invention generally relates to electrical connectors, especially to straddle electrical connectors attached to the edge of circuit boards.

BACKGROUND OF THE INVENTION

So-called straddle connectors are used for connection by a surface mount technology (SMT) method to the edges of circuit boards having on both surfaces electrical traces. Such straddle connectors have two rows of electrical contacts, and an edge of the circuit board having electrical traces formed on both surfaces is inserted between the contact sections of the straddle connector. The contacts are connected to corresponding electrical traces using soldering practices known in the art.

An example of a conventional straddle connector 100 is shown in FIG. 5, which has a number of electrical contacts 102 arranged in two rows in an insulating housing 101. Under normal conditions, contact sections 103 of the contacts 102 are inclined toward each other due to their resilience so that the distance between the soldering sections 104 of the sections 103 is less than the thickness of the circuit board 110 together with the conductive pads 111, 112 and solder coatings 113, 114 attached to them. After straddle connector 100 is placed over the edge of the circuit board 110, contact sections 103 are soldered to corresponding conductive pads 111, 112 using an infra red beam or other method of heating.

The conventional straddle connector 100 shown in FIG. 5 suffers from a disadvantage that when it is mounted on the circuit board 110, contact sections 103 can scrape solder coatings 113, 114 off conductive pads 111, 112. This problem originates from the fact that the distance between the soldering sections 104 of contact sections 103 is smaller than the thickness of the circuit board 110. It is obvious that if the distance between the soldering sections 104 is larger than the thickness of the board, it will be impossible to solder them to conductive pads 111, 112 via solder coatings 113, 114 even when they are heated. If the solder coatings 113, 114 are scraped off, appropriate soldering of the soldering sections 104 to the conductive pads 111, 112 cannot be achieved. Therefore, the reliability of the soldered connections is substantially compromised.

A number of efforts and attempts were made to improve reliability of the SMT methods. One of such methods is described in Japanese Patent Publication No. 1991-257776. According to this publication, in order to achieve a complete connection of the contacts of a connector having one row of SMT contacts, the contacts, or leads, at the time of connection of the connector to a circuit board, are deflected or shifted away from the conductive pads and after alignment are pressed against them. For this purpose, in one specific embodiment, lugs are provided in the opening of the connector for the insertion of the circuit board into the connector, and the circuit board has depressions whose locations correspond to the lugs. If the SMT contacts are arranged in two rows, the front ends of the contact are deflected outwardly to make the gap between them wider than the thickness of the circuit board using the lugs and depressions.

Another conventional method is described in Japanese Utility Model Publication No. 1992-78787. In the connector described therein, solder tails of the contacts arranged in two rows are arranged in one row. The connector is mounted to the edge of a circuit board in a pivoted manner. Therefore, the contacts do not exert pressure on the solder coatings on the conductive pads of the circuit board until it is completely mounted, thus avoiding scraping off the solder coatings.

However, the straddle connectors described above still have some disadvantages. For example, in the first design, it is difficult to deflect all soldering sections of the contacts uniformly if the connectors have many contacts, thus making it difficult or impossible to attain reliable connection of all contacts. The straddle connector of the second design has a disadvantage in that it is not suitable for high-density-mounting applications by SMT methods to circuit boards with electrical traces on both surfaces.

SUMMARY OF THE INVENTION

Therefore, the purpose of this invention is to provide a straddle connector in which all the electrical contacts are uniformly pressed onto the solder coated conductive pads when the circuit board is inserted into the connector.

Another purpose of this invention is to provide a straddle connector for an automatic change of width of the gap between the contacts when the connector is attached to a circuit board, thus avoiding scraping of the solder coatings from the conductive pads.

In order to solve the problems and to achieve the purposes of this invention, a straddle connector according to this invention comprises a base housing having a number of electrical contacts arranged in two rows along inner walls of an opening for the insertion of a circuit board into the connector, and a separator is disposed in the opening between the contact sections of the contacts maintaining them in a biased position and spaced for engagement with the contacts. When the separator is engaged with the edge of the circuit board upon being inserted in the connector, the separator moves along guide channels provided in the housing due to the action of the inserted circuit board into the connector causing the biased contacts to engage the solder-coated conductive pads on the circuit board.

BRIEF DESCRIPTION OF THE DRAWINGS

An embodiment of the invention is described by way of example with reference to the accompanying drawings in which.

DESCRIPTION OF THE INVENTION

Figures 1, 2:
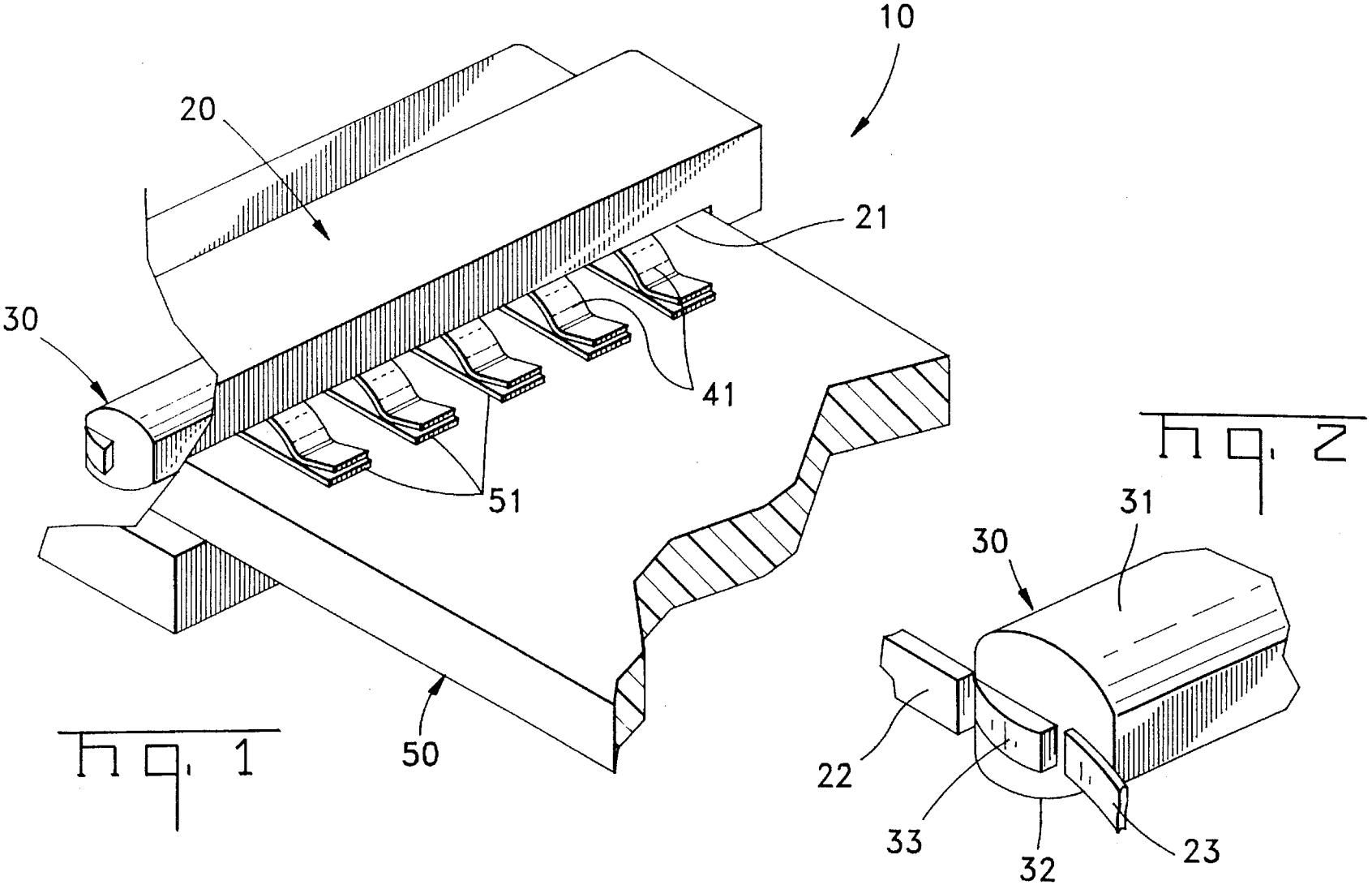
FIG. 1 is a perspective and partly-broken away view of an embodiment of the straddle connector according to this invention.
FIG. 2 is an enlarged part-perspective view of a detail.
Figure 3:
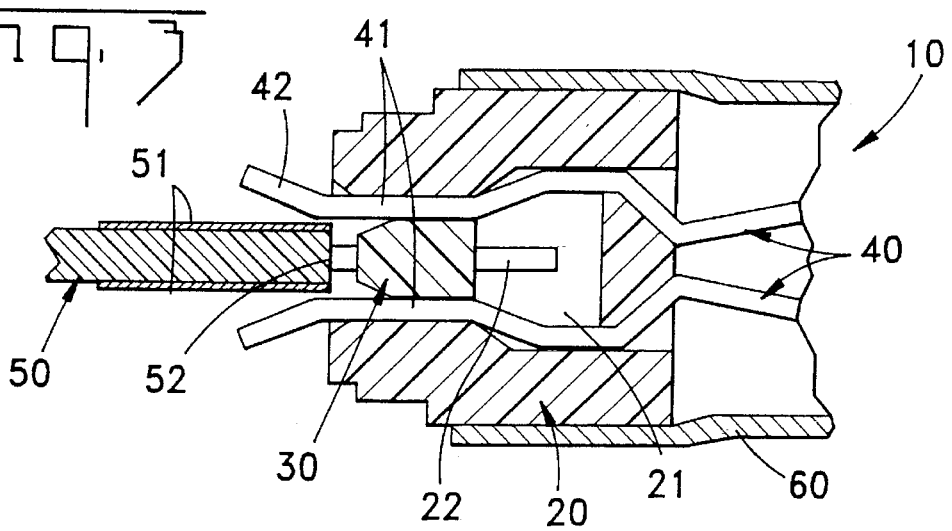
FIG. 3 is cross-sectional view of the connector of FIG. 1 prior to a circuit board being inserted thereinto.

FIGS. 1–3 show an embodiment of the straddle connector 10 according to this invention.

The straddle connector 10 according to this invention comprises an insulating housing 20, electrical contacts 40 arranged in two rows and a dielectric separator 30 which is located in an opening 21 of the housing 20 wherein it can move. The housing 20 is molded, preferably from a suitable insulating plastic, and it is of a flat shape with the opening 21 for the insertion of an edge of a circuit board 50. At the edge of the circuit board 50, on both surfaces, spaced conductive pads 51 are located. The conductive pads 51 are coated with solder (not shown in the drawing) and connection sections 41 are brought in a position suitable for the SMT connection. On both sides of the opening 21 of the housing 20, guide channels 22 are located, and when the circuit board 50 is inserted in opening 21, separator 30 moves along guide channels 22.

On both sides of separator 30, cam surfaces 31, 32 engage connection sections 41 of contacts 40. As shown in FIG. 2, at both ends of separator 30, wedge-shaped members 33 are provided which fit into corresponding guide channels 22.

In the housing 20, resilient levers 23 located at the beginning of the guide channels 22 are provided which retain the separator 30 in the opening 21 once it is assembled within the housing 20. This can be best understood from FIG. 2. As can be seen from the same drawing, when the separator 30 is inserted in the guide channels 22 in the housing 20 against resilient resistance of the levers 23, the free ends of the resilient levers 23 lock behind the flat surface of the wedge-shaped members 33, thus maintaining the separator within the opening 21. If, for some reason, it becomes necessary to remove the separator 30, the resilient levers 23 can be bent inwardly by a screw driver, thus freeing the members 33 and the separator 30 can be removed from the housing 20.

Figure 4:
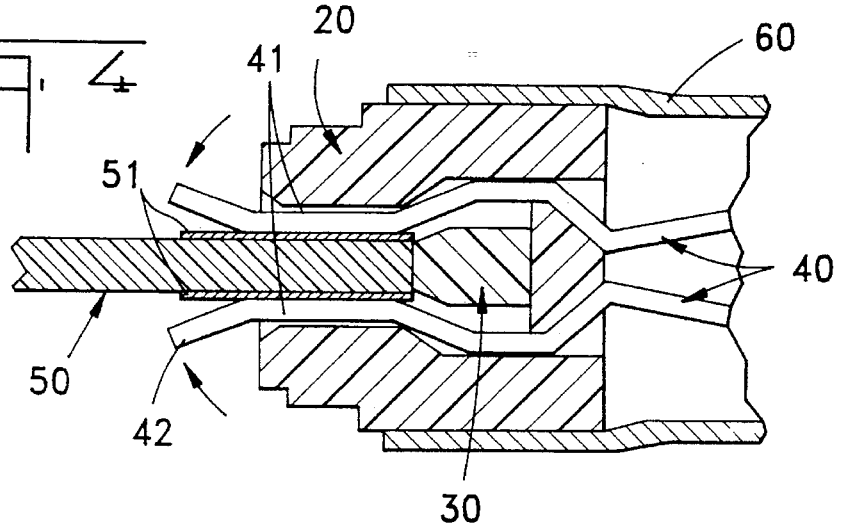
FIG. 4 is a view similar to FIG. 3 showing the circuit board completely inserted into the connector.
Figure 5:
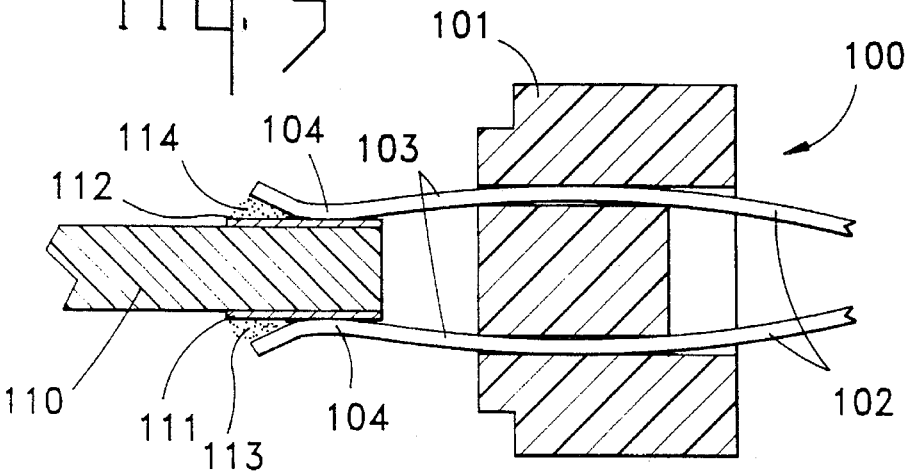
FIG. 5 is a cross-sectional view of a conventional straddle connector.

Next, the interaction of the contacts 40, housing 20, separator 30 and circuit board 50 by referring to essential parts of the straddle connector 10 shown in the FIGS. 3 and 4 will be explained. FIG. 3 shows the first step of the insertion of the circuit board 50 into the connector 10. FIG. 4 shows the edge of the circuit board 50 completely inserted into the connector 10.

As can be clearly seen from FIG. 3, the contacts 40 are arranged in two rows along the walls of the opening 21 of the housing 20. As follows from the same drawings the inner part of the opening 21 of the housing 20 is wider than the opening. Connection sections 41 of the contacts 40 are bent to follow this configuration; and, in the normal state, that is when no external force is applied to them, they are facing each other. The distance between the opposing connection sections 41 (with the exception of the outwardly-directed ends 42) is smaller than the thickness of the circuit board 50. The ends 42 of the connection sections define a guide for the circuit board 50.

As shown in the FIG. 3 before the straddle connector 10 is connected to the circuit board 50, the separator 30 is retained near the front of opening 21 due to the engagement between cam surfaces 31, 32 and connection sections 41. Due to the this engagement between the cam surfaces 31, 32 of the separator and the connection sections 41, the connection sections 41 are spaced apart so as not to touch the solder-coated conductive pads 51. It shall be noted that in this state, connection sections 41 do not scrape solder from the conductive pads 51 even when the circuit board 50 is inserted in the opening 21.

When the circuit board 50 is being inserted in the opening 21 of the housing 20, the front edge 52 of the circuit board 50 comes in contact with the separator 30. When the circuit board 50 is inserted further, the separator 30 also begins to move along the guide channels 22. When the circuit board 50 is completely inserted in the opening 21 of the housing 20, the separator 30 arrives at the inner part of the opening 21 as shown in FIG. 4. In this position, the connection sections 41 are bent outwardly, the cam surfaces 31, 32 of the separator 30 are out of contact with connection sections 41. As a result, the connection sections 41, due to their resiliency return to their normal position as shown by the arrows in FIG. 4.

In this final position of the circuit board 50 within opening 21 of straddle connector 10, connection sections 41 are pressed onto the solder-coated conductive pads 51 thereby providing the required pressure onto the solder-coated conductive pads. The solder is melted using an infra red or other source of heat and reliable SMT-type connections between corresponding conductive pads 51 connection sections 41 are thus obtained. From the explanations given above, it is clear that when the straddle connector 10 is being connected to the edge of the circuit board 50, the gap or distance between connection sections 41 automatically changes to accommodate the circuit board. Attention is drawn to the fact that as the result of the present invention, no scraping-off of solder from the conductive pads by connection sections 41 takes place, and highly reliable SMT soldered connections are obtained.

By placing a metal case or a shield member 60 over the housing 20 of the straddle connector 10 according to the specific embodiment disclosed herein, it is possible to achieve high-quality transmission of high-frequency signals.

Explanations concerning embodiments of the straddle connector according to this invention have been given, but it must be understood that the invention covers various modifications without deviation from essential elements of the invention.

As follows from the above explanations, in the straddle connector according to this invention, the gap between the opposed connection sections of the contacts arranged in two rows automatically changes with the insertion of the circuit board therebetween. The gap between the connection sections is wider than the thickness of the circuit board until the edge of the circuit board is completely inserted in the opening of the housing. Due to the fact that it is possible to change the width of the gap between the connection sections while inserting the circuit board, the solder coatings on the conductive pads are not scraped off by the connection sections. However, when the circuit board is completely inserted into the openings, the connection sections are pressed against the solder-coated conductive pads, thus making it possible to obtain highly reliable SMT soldered connections.

I claim:

1. A straddle connector for connection to solder-coated conductive pads on both surfaces of a circuit board when inserted into the connector, comprising:

an insulated housing having an opening;

rows of electrical contacts secured in said housing and having connection sections extending along opposed walls of said opening;

a dielectric separator disposed in said opening between said connection sections maintaining said connection sections in a biased condition and spaced apart a distance greater than the thickness of the circuit board; and guide means on the housing within said opening and on said separator for guiding said separator into said opening upon engagement of the circuit board with the separator when the circuit board is inserted into said opening between the connection sections so that when the separator is moved free of the connection sections under the insertion force of the circuit board into the opening, the connection sections engage the solder-coated conductive pads on both surfaces of said circuit board for solder connections thereto.

2. A straddle connector as claimed in claim 1, wherein the guide means comprise guide channels in side walls of said opening and wedge-shaped members on the ends of said separator disposed in said guide channels.

3. A straddle connector as claimed in claim 2, wherein said wedge-shaped members include a flat surface and resilient levers mounted onto said housing engage said flat surface thereby maintaining said separator within said opening.

4. A straddle connector as claimed in claim 1, wherein said connection sections have outwardly-directed front ends.

5. An electrical connector for connection to solder-coated conductive pads on a surface of a circuit board when inserted into the connector; comprising:

an insulated housing having an opening;

electrical contacts secured in said housing and having connection sections extending along a wall of said opening;

a dielectric separator disposed in said opening engaging said connection sections thereby maintaining said connection sections in a biased condition; and guide means on the housing within the opening and on said separator for guiding said separator into said opening upon engagement of the circuit board with said separator when the circuit board is inserted into said opening so that said separator is moved free of said connection sections under the insertion force of the circuit board into said opening whereby the connection sections engage the solder-coated conductive pads on said circuit board for solder connections thereto.

6. An electrical connector as claimed in claim 5 wherein other electrical contacts are secured in said housing and having other connection sections extending along another wall of said opening so that said connection sections are opposed and spaced from each other whereby said separator is positioned between the opposed connection sections.

7. An electrical connector as claimed in claim 5, wherein said guide means comprise guide channels in side walls of said opening and wedge-shaped members at the ends of said separator disposed in said guide channels.

* * * * *